US005746310A

United States Patent [19]

Slomski

[11] Patent Number: 5,746,310

[45] Date of Patent: May 5, 1998

[54] WELDED CONTAINER CARRIER

[75] Inventor: Edward J. Slomski, Crystal Lake, Ill.

[73] Assignee: Illinois Tool Works Inc., Glenview, Ill.

[21] Appl. No.: 760,482

[22] Filed: Dec. 5, 1996

[51] Int. Cl.[6] ..... B65D 71/00

[52] U.S. Cl. ..... 206/150; 206/151; 206/162; 206/199; 294/87.2

[58] Field of Search ..... 206/139, 143, 206/150, 151, 161, 162, 167, 169, 192, 199, 427

[56] References Cited

U.S. PATENT DOCUMENTS

| | | | |
|---|---|---|---|
| 3,325,004 | 6/1967 | Wanderer . | |
| 3,504,790 | 4/1970 | Owen . | |
| 3,513,970 | 5/1970 | Eckholm . | |
| 3,682,352 | 8/1972 | Doucette | 206/150 |
| 3,727,754 | 4/1973 | Cunningham | 206/150 |
| 3,784,003 | 1/1974 | Bolton . | |
| 3,820,657 | 6/1974 | Klygis et al. . | |
| 3,946,862 | 3/1976 | Klygis et al. . | |
| 5,441,147 | 8/1995 | Tanner | 206/150 |
| 5,487,465 | 1/1996 | Broskow . | |
| 5,535,879 | 7/1996 | Appleton | 206/150 |
| 5,593,026 | 1/1997 | Broskow | 206/150 |

*Primary Examiner*—Paul T. Sewell
*Assistant Examiner*—Luan K. Bui
*Attorney, Agent, or Firm*—Speckman Pauley Petersen & Fejer

[57] ABSTRACT

This invention relates to a container carrier for unitizing a plurality of containers comprising two sheets of material joined along at least two generally parallel lines of connection. A panel is defined by at least one of the sheets between the lines of connection. Each sheet of the material contains at least one first receiving opening for engaging an upper portion of a container separated from the panel by a first line of connection. Each sheet of material also contains at least one second receiving opening for engaging a lower portion of a container separated from the panel by a second line of connection. After, during, and just before, application to a plurality of containers, each first receiving opening is preferably vertically aligned with each second receiving opening of each sheet. The carrier according to this invention engages a plurality of containers to comprise an assembled package. Preferably, an integral handle is positioned on the package, such as at an area near a front side of the package, to enable a consumer to conveniently grasp the package.

12 Claims, 2 Drawing Sheets

WELDED CONTAINER CARRIER

BACKGROUND OF THE INVENTION

1. Field of the Invention

This invention relates to a container carrier constructed of two sheets of flat flexible material joined by at least two lines of connection to form upper and lower container engaging sides separated by a central panel.

2. Description of Prior Art

Broskow, U.S. Pat. No. 5,487,465, teaches a carrier constructed by joining two layers of sheet material. The Broskow patent teaches a plastic container carrier which has container engaging portions that extend from a single joint. The joint is formed by bonding the edges of two plastic sheets that form two generally planar rows of container engaging portions. The Broskow patent also shows a handle portion which may extend from the joint.

Klygis et al., U.S. Pat. No. 3,946,862, teaches a two-piece bottle carrier with a top sheet for gripping the top portions of a plurality of bottles and a separate complementary bottom member for encircling and gripping the bottom portions of at least two containers.

Wanderer, U.S. Pat. No. 3,325,004; Owen, U.S. Pat. No. 3,504,790; and Bolton, U.S. Pat. No. 3,784,003 each teach a single-piece carrier cut from a single sheet of material that is configured to engage a top portion and a bottom portion of each of a plurality of containers. The Owen and Wanderer patents both teach a carrier having a plurality of upper rings and lower rings, each upper ring for engaging an upper portion of a container and each lower ring for engaging a lower portion of a container. The Bolton patent teaches a sheet for engaging an upper portion of each of a plurality of containers, and a strap which encircles the package at a lower portion of the plurality of containers.

SUMMARY OF THE INVENTION

It is one object of this invention to provide a container carrier that unitizes a plurality of containers into a tight, solid package.

It is another object of this invention to provide a stable container carrier resulting from a first line of connection which defines a first container engaging side and a second line of connection which defines a second container engaging side.

It is still another object of this invention to provide a container carrier which restricts lateral and vertical movement of the containers with respect to one another.

It is another object of this invention to provide a container carrier that maintains material separation between each adjacent container within the package.

It is yet another object of this invention to provide a container carrier that may be grasped from an area a near a front side of the unitized package.

The carrier of this invention comprises two sheets of flat flexible material which are preferably layered contiguously with respect to one another. The two sheets of material are joined along a first line of connection and a second line of connection generally parallel to one another. The respective lines of connection are positioned at a distance from one another. At least one of the two sheets comprises a panel between the first line of connection and the second line of connection. When applied to containers, the resulting carrier configuration resembles that of an I-beam.

Each sheet of the material contains at least one first receiving opening for engaging an upper portion of a container, the first line of connection dividing the first receiving opening from the panel. Each sheet of material also contains at least one second receiving opening for engaging a lower portion of a container, the second line of connection dividing the second receiving opening from the panel. After, during, and just before application to a plurality of containers, each first receiving opening is preferably vertically aligned with each second receiving opening of each sheet.

The carrier engages a plurality of containers to form an assembled, unitized package. Preferably, an integral handle is positioned on the package, such as in an area near a front side of the package, to enable a consumer to conveniently grasp the handle.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
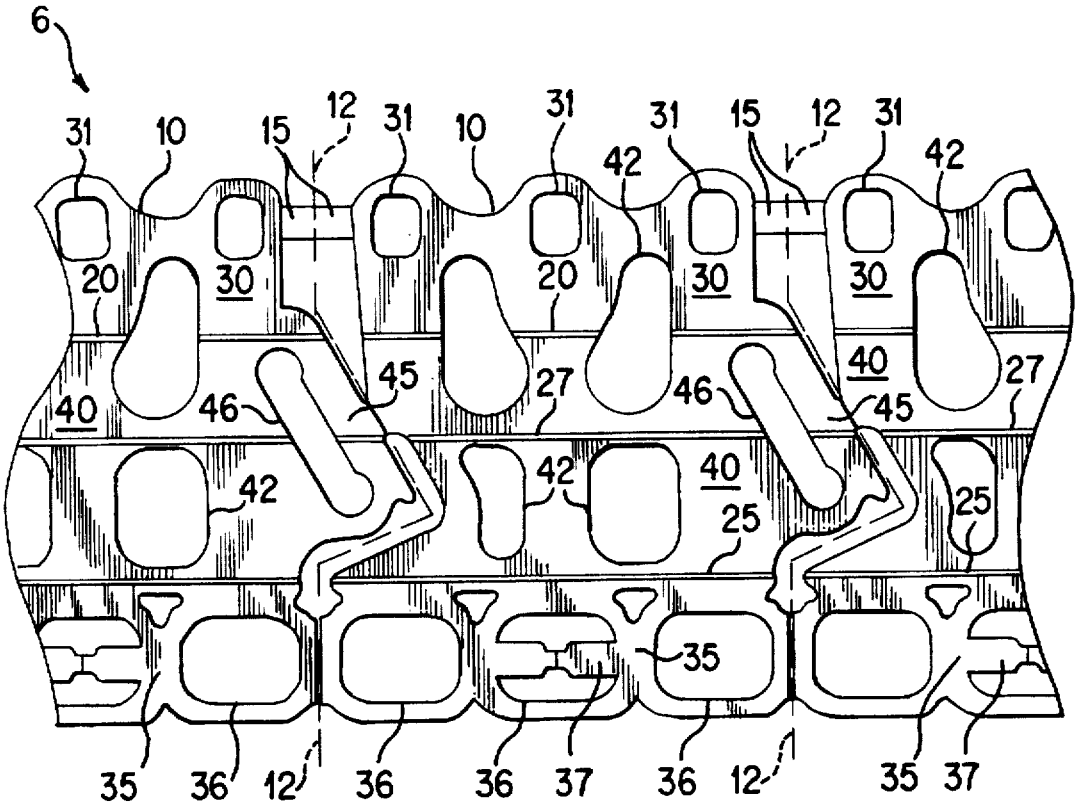
FIG. 1 is a plan view of a portion of a continuous strip of carriers, according to one preferred embodiment of this invention.
Figure 2:
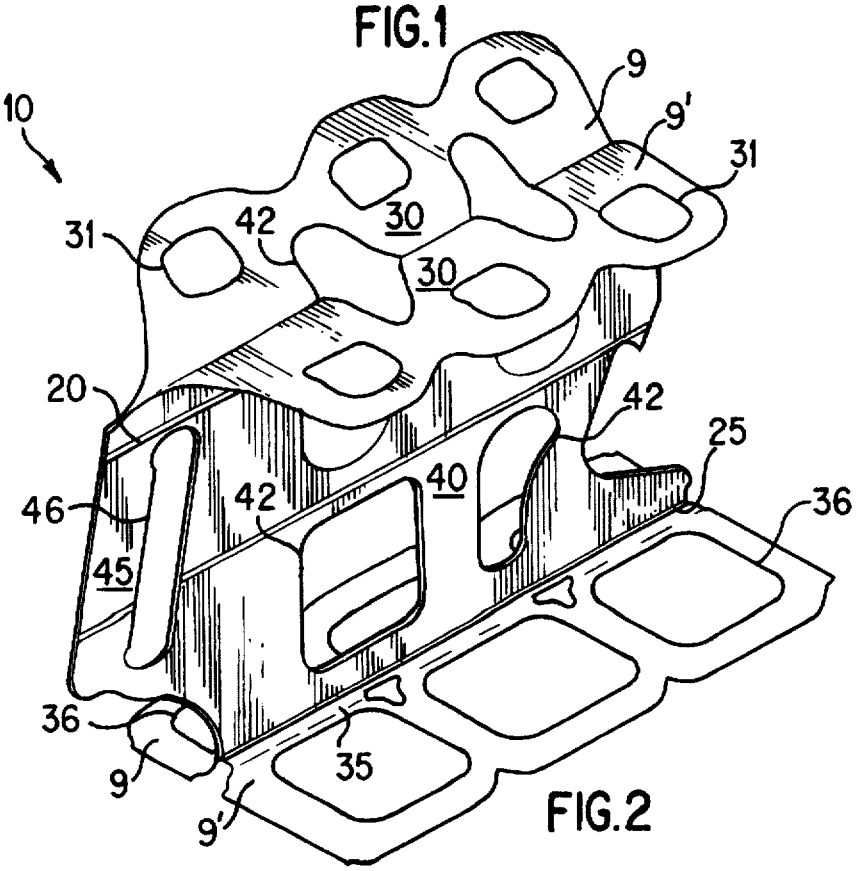
FIG. 2 is a perspective view of one of the carriers shown in FIG. 1.
Figure 3:
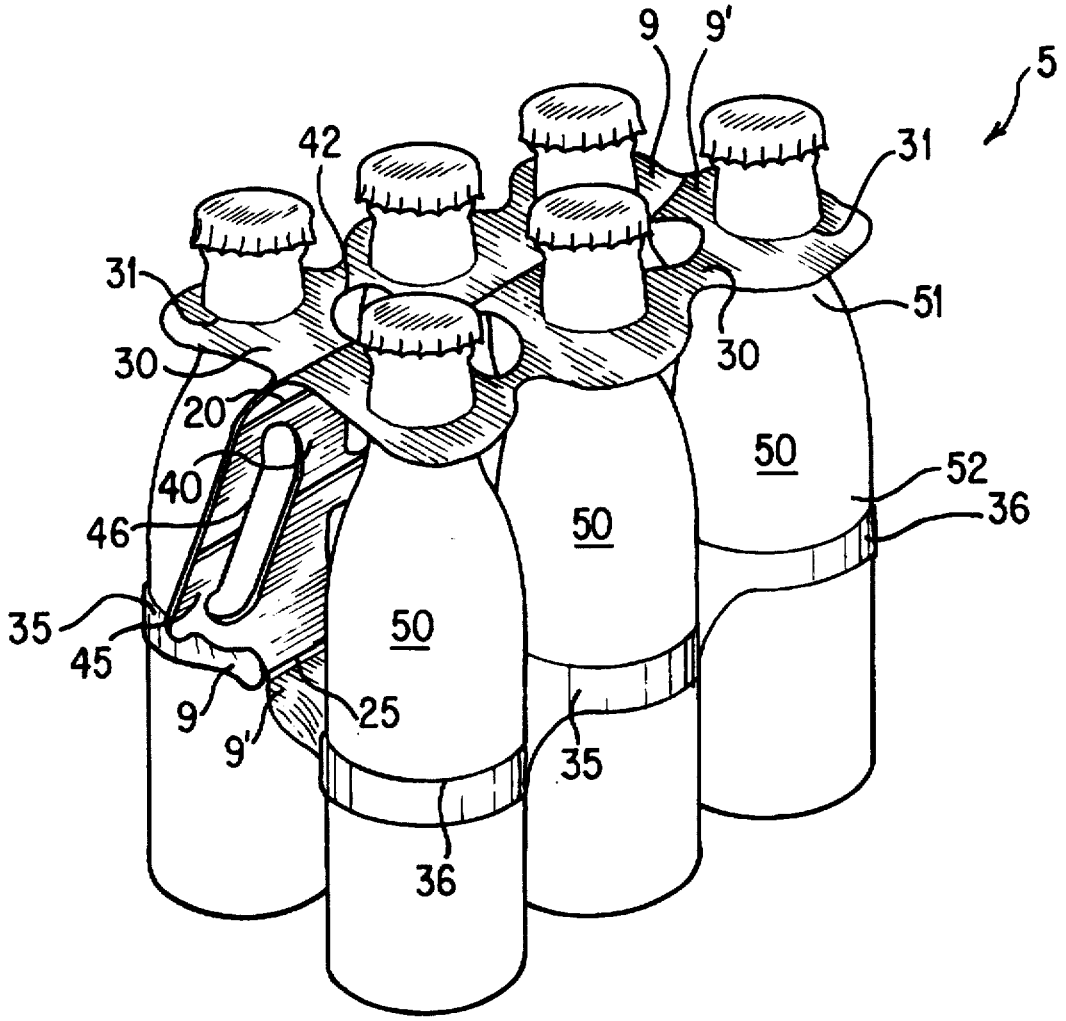
FIG. 3 is a perspective view of the carrier of FIG. 1 applied to containers, according to one preferred embodiment of this invention.

Carrier 10, shown in FIGS. 1–3, unitizes a plurality of containers 50 to create package 5, such as package 5 shown in FIG. 3. Containers 50 may comprise cans, bottles, jars, boxes or any other container suitable for unitization into package 5. According to one preferred embodiment of this invention, shown in FIG. 3, containers 50 are glass bottles.

FIGS. 1 and 2 show one preferred embodiment of carrier 10. Carrier 10 comprises two sheets 9, 9' as shown in FIG. 2. Sheets 9, 9' are preferably constructed from a flexible, resilient material such as plastic. In one preferred embodiment of this invention, sheets 9, 9' are made from low density polyethylene.

Sheets 9, 9' of material are preferably cut, using means known to those skilled in the art, such as a stamping die, to form continuous strip 6 of carriers 10 as partially shown in FIG. 1. FIG. 1 shows one preferred embodiment of this invention wherein sheets 9, 9' are layered to form carrier 10, therefore the FIG. 1 plan view does not show separate sheets 9 and 9'. The stamping die preferably cuts both sheets simultaneously to form two contiguously layered sheets 9, 9' connected by lines of connection 20, 25, 27, as described below.

In one preferred embodiment of this invention, each carrier 10 within continuous strip 6 is separated by division 12 from each adjacent carrier 10. Division 12 between carriers 10 within continuous strip 6 is cut or separated by weakened portions across a pitch line (i.e. the end to end dimensions of each carrier 10) of each adjacent carrier 10, and is not a straight cut or separation line, within continuous strip 6. Tabs 15, such as those shown in FIG. 1, are preferably positioned between each adjacent carrier 10 of continuous strip 6 to aid in alignment and control of carriers 10 as continuous strip 6 is rolled to and from production reels. Perforations may be included between adjacent tabs 15. In a preferred embodiment, a handle 45 extends beyond the pitch line and into a recess formed in the next adjacent carrier 10 to minimize material usage and assist in winding and feeding continuous strip 6 of carriers 10.

Sheets 9, 9', which preferably comprise carrier 10, are connected with respect to one another along at least two lines of connection 20, 25. One preferred method of connection is taught by Broskow, U.S. Pat. No. 5,487,465. The Broskow patent teaches placing a narrow band of material, such as low density polyethylene, between two 10 sheets of material resulting in three layers of material. The three layers are then heat sealed using heated rollers, thus forming a single weld that merges the three layers of material. Lines of connection 20, 25 may be created as taught by the Broskow patent but may also be created with adhesives, fasteners or any other method which firmly attach sheet 9 to sheet 9'.

First line of connection 20 is preferably spaced at a distance from second line of connection 25. In one preferred embodiment of this invention, sheets 9, 9' form panel 40 in a central portion of carrier 10 between first line of connection 20 and second line of connection 25. Panel 40 is preferably defined at two ends by first line of connection 20 and second line of connection 25. In one preferred embodiment of this invention, third line of connection 27 connects sheet 9 to sheet 9' and provides added structural strength within panel 40. Additional lines of connection may be positioned within panel 40 to further stiffen panel 40.

In one preferred embodiment of this invention, panel 40 has one or more panel apertures 42. Panel apertures 42 are preferably positioned in non-critical areas of panel 40 such as those areas shown in FIG. 1. Panel apertures 42 are used to both economize material and create a more streamlined and inconspicuous appearance of carrier 10. In one preferred embodiment of this invention, panel apertures 42 extend beyond first line of connection 20 and/or second line of connection 25.

Carrier 10 further comprises a first container engaging side 30 and a second container engaging side 35. First container engaging side 30 and second container engaging side 35 are positioned on opposite sides of panel 40 and are separated from panel 40 by first line of connection 20 and second line of connection 25, respectively. Each container engaging side 30, 35 preferably comprises portions of both sheets 9, 9' extending from respective line of connection 20, 25 to a respective end of carrier 10. Container engaging side 30, 35 is connected to panel 40 at respective line of connection 20, 25. Lines of connection 20, 25 join sheets 9, 9' along an edge of panel 40 of respective container engaging side 30, 35. Sheets 9, 9' are not attached at an edge of container engaging side 30, 35 opposite respective line of connection 20, 25.

As a result of the preferred embodiment of container engaging sides 30, 35 discussed above, carrier 10 resembles an I-beam just prior to, during, and after application of carrier 10 to containers 50.

In one preferred embodiment of this invention, each container engaging side 30, 35 comprises both sheet 9 and sheet 9'. In the preferred embodiment shown in FIGS. 1–3, both container engaging sides 30, 35 comprise opposite sides of common sheets 9, 9'.

First container engaging side 30 preferably comprises sheets 9, 9', each sheet 9, 9' having at least one first receiving opening 31. Preferably, each sheet 9, 9' has the same number of first receiving openings 31, such that first container engaging side 30 has an even number of first receiving openings 31. FIGS. 1–3 show first container engaging side 30 having a plurality of first receiving openings 31 each configured to engage neck 51 of container 50. Therefore, in one preferred embodiment of this invention, first receiving opening 31 is sized to accommodate a tapered container 50, such as a bottle. First receiving opening 31 may be sized to accommodate containers 50 such as cans having a generally constant sidewall 52 diameter.

Like first container engaging side 30, second container engaging side 35 preferably comprises sheets 9, 9', each sheet 9, 9' having at least one second receiving opening 36. Preferably, each sheet 9, 9' has the same number of second receiving openings 36 such that second container engaging side 35 has an even number of second receiving openings 36. In one preferred embodiment of this invention, second receiving opening 36 is sized to hold a lower portion of container 50, such as sidewall 52.

In one preferred embodiment of this invention shown in FIGS. 1–3, handle 45 is integral with respect to carrier 10. As shown in FIGS. 1–3 handle 45 may extend from panel 40 from an area near a front side of carrier 10, between first line of connection 20 and second line of connection 25. In another preferred embodiment of this invention, handle 45 is integral with first container engaging side 30. In an alternate embodiment of this invention, handle 45 may be attached along first line of connection 20 and extend upwardly from first container engaging side 30. In still another embodiment of this invention, a portion of one or more panel apertures 42 may extend into first container engaging side 30 and provide a gripping area for a top lift preferred embodiment of package 5.

Handle 45 shown in FIGS. 1–3 is advantageous because package 5 is easily lifted from a store fixture wherein columns of packages 5 are aligned in rows between closely spaced shelves. Handle 45 is positioned near a front side of package 5, and includes an aperture 46 angled downwardly and outwardly to enable a consumer to easily grasp and remove package 5 from within such a fixture and to reposition package 5 on a horizontal surface, e.g. a table.

Carrier 10 is applied to containers 50 by stretching container receiving openings 31, 36 over containers 50, such that container receiving openings 31, 36 conform to sidewalls 52 and/or necks 51 of containers 50. In one preferred embodiment of this invention, carrier 10 is configured to engage six containers 50 although carrier 10 may be configured to engage two, four, eight or any other preferably, but not necessarily, even number of containers 50.

In one preferred embodiment of this invention, at least one divider 37 is integrated with container receiving openings 31, 36 such that when carrier 10 is applied to containers 50, dividers 37 are positioned between each adjacent container 50 within lateral rows of containers 50. FIG. 1 shows divider 37 as used with respect to second receiving opening 36 for carrier 10 configured to engage bottles. In one preferred embodiment of this invention, divider 37 splits in half upon application to container 50 and is positioned between each adjacent container 50 within lateral rows defined by second receiving openings 36.

Panel apertures 42 preferably are positioned such that panel 40 remains between adjacent containers 50. In one preferred embodiment of this invention, panel apertures 42 are generally aligned with gaps between necks 51 of adjacent containers 50 in package 5, thus leaving little of panel 40 remaining in sight.

The combination of first container engaging side 30, second container engaging side 35, divider 37, and panel 40 provide material for separation between containers 50. Such separation is especially important with respect to glass containers 50 and containers 50 having a label or other affixation which may become detached or abraded.

As described above, package 5 may comprise bottles, cans or other suitable containers 50. According to a preferred embodiment of this invention shown in FIGS. 1–3, carrier 10 is configured to engage bottles. It is advantageous for carrier 10 to hold each container 50 in both vertical and horizontal alignment with respect to each adjacent container 50. Therefore, in package 5, a center of first receiving opening 31 should be approximately vertically aligned with a center of second receiving opening 36. If containers 50 within package 5 are not in general vertical alignment, for example if one end of container 50 is splayed with respect to package 5, containers 50 will rub against one another and may seriously abrade or even break or split.

In this embodiment, first line of connection 20 is spaced an appropriate distance from second line of connection 25, to enable first container engaging side 30 to remain generally planar and generally perpendicular to panel 40. If first line of connection 20 is too close to second line of connection 25, first container engaging side 30 will have a generally V-shaped profile. A V-shaped profile of first container engaging side 30 will cause containers 50 to splay outward at a bottom portion of package 5. This condition results from first container engaging side 30 drawing an upper portion of containers 50, such as neck 51, inward toward panel 40. Therefore, spacing between first line of connection 20 and second line of connection 25 is critical in maintaining vertically aligned containers 50 within package 5.

Panel 40 within package 5 provides an indication of proper spacing between first line of connection 20 and second line of connection 25. In package 5, panel 40 should be generally vertical with a small amount of slack between first line of connection 20 and second line of connection 25. Containers 50 in package 5 will splay out at a bottom portion or a top portion of package 5 if panel 40 is overly taut between first line of connection 20 and second line of connection 25.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

I claim:

1. A carrier for carrying a plurality of containers in adjacent rows, the carrier comprising:

two sheets of plastic material, a first line of connection and a second line of connection joining the two sheets together, the first line of connection spaced at a distance from the second line of connection;

a panel of at least one of the sheets positioned between the first line of connection and the second line of connection so that the carrier when carrying a plurality of containers has the panel positioned between the rows of containers;

each of the sheets having at least one first receiving opening above the first line of connection and at least one second receiving opening below the second line of connection; and at least one of the sheets forming a handle.

2. The carrier of claim 1 wherein at least one of the first line of connection and the second line of connection is a weld.

3. The carrier of claim 1 wherein at least one of the first line of connection and the second line of connection is continuous.

4. The carrier of claim 1 wherein at least one of the first line of connection and the second line of connection is intermittent.

5. The carrier of claim 1 wherein the first line of connection is generally parallel to the second line of connection.

6. The carrier of claim 1 wherein the panel has at least one aperture.

7. The carrier of claim 1 wherein the handle is integral with the panel.

8. The carrier of claim 7 wherein the handle extends between the first line of connection and the second line of connection and extends outwardly from one extremity of the carrier, an aperture in the handle extending downwardly and outwardly from the extremity of the carrier.

9. The carrier of claim 1 wherein the handle is integral with a portion of the sheets defining the upper receiving openings.

10. The carrier of claim 1 wherein the two sheets are joined with a third line of connection.

11. The panel of claim 10 her comprising at least one additional line of connection in the panel.

12. A carrier for carrying a plurality of containers in adjacent rows comprising:

two container engaging sides, each of the container engaging sides comprising two sheets, each of the two sheets having at least one receiving opening;

a panel positioned between the rows of containers in an assembled carrier;

a first line of connection joining the two sheets of one of the container engaging sides to one end portion of the panel;

a second line of connection joining the other of the container engaging sides to another end portion of the panel which is opposite the one end portion;

a first outer region of the first line of connection and a second outer region of the second line of connection; and a direct connection extending between the first line of connection and the second line of connection at least connecting the first outer region to the second outer region. he total number of claims is less than twenty.

* * * * *